United States Patent [19]

Koizumi

[11] Patent Number: 4,970,736

[45] Date of Patent: Nov. 20, 1990

[54] MULTI-FUNCTIONAL BED FOR ATTENDING TO THE DAILY HYGIENIC NEED OF AN INFIRM PATIENT

[76] Inventor: Yasunori Koizumi, 105, 1st Villa Toyo, 2953, Noborito, Tama-ku, Kawasaki-shi, Japan

[21] Appl. No.: 385,830

[22] Filed: Jul. 12, 1989

[30] Foreign Application Priority Data

Jul. 12, 1988 [JP] Japan ..... 63-92398[U]

[51] Int. Cl.[5] ..... A61G 7/002; A61G 7/02

[52] U.S. Cl. ..... 5/61; 5/60; 5/90; 5/414; 4/547; 4/611; 4/597; 4/535; 4/564

[58] Field of Search ..... 5/1, 60, 61, 62, 65, 5/66, 88, 90, 421, 423, 414; 4/535, 546, 560, 564, 565, 567, 568, 584, 597, 604, 663, 664, 665, 547, 611

[56] References Cited

U.S. PATENT DOCUMENTS

| | | | |
|---|---|---|---|
| 1,059,314 | 4/1913 | Petter | 4/597 |
| 1,242,545 | 10/1917 | Hanger | 5/1 |
| 2,761,152 | 9/1956 | Pirone | 5/88 |
| 2,788,527 | 4/1957 | Steven | 4/565 |
| 3,613,127 | 10/1971 | Bond | 4/597 |
| 3,701,170 | 10/1972 | Bond | 4/597 |
| 4,017,914 | 4/1977 | Brown | 5/60 |
| 4,112,524 | 9/1978 | Johansson | 4/664 |
| 4,270,234 | 6/1981 | James | 5/90 |
| 4,671,284 | 6/1987 | Wilson | 5/60 |
| 4,821,348 | 4/1989 | Pauna | 5/90 |

FOREIGN PATENT DOCUMENTS

| | | | |
|---|---|---|---|
| 123199 | 1/1947 | Australia | 5/90 |
| 69794 | 1/1983 | European Pat. Off. | 5/60 |
| 670541 | 12/1938 | Fed. Rep. of Germany | 5/1 |
| 13532 | of 1910 | United Kingdom | 5/60 |

*Primary Examiner*—Gary L. Smith
*Assistant Examiner*—F. Saether
*Attorney, Agent, or Firm*—Cushman, Darby & Cushman

[57] ABSTRACT

Disclosed is a multi-functional bed for a patient or a fairly aged person. The bed performs multiple functions. It is provided with a lower capsule supported by a metallic supporting frame, an upper capsule mounted on the lower capsule, a movable and rotatable portion which is supported by the metallic supporting frame, a plurality of removable cushions placed on the movable portion, and a net which can be wound or unwound by a winding portion disposed on the underside of said movable portion. The bed includes a stool, bath tub, shower, dryer and heat lamp. The use of the multi-functional bed allows the patient or the like to excrete lying in bed and also to take a bath by way of having his body lowered in the net into the bath tub, with the consequence that the nurse or attending person can keep the patient in good hygienic condition.

6 Claims, 6 Drawing Sheets

MULTI-FUNCTIONAL BED FOR ATTENDING TO THE DAILY HYGIENIC NEED OF AN INFIRM PATIENT

BACKGROUND OF THE INVENTION

1. Field of the Invention

This invention relates to a multi-functional bed, and more specifically to a bed which performs a number of functions to accomplish thorough care for a hospitalized patient who suffers from a serious disease or an aged person who is so feeble as to be confined to bed.

2. Description of the Prior Art

Conventionally, an ordinary bed has been widely used in looking after a hospitalized patient who suffers from a serious disease or an aged person who is confined to bed. Such a patient or aged person (hereinafter referred to as a patient) is made to wear diapers to facilitate treatment of his excrements.

The above-mentioned method causes much inconvenience to a nurse or attending person (hereinafter referred to as a nurse) who is taking care of the patient. In addition, there still remains a problem that the hygienic conditions of the patient can not be well maintained for the amount of labor the nurse or is obliged to undertake.

SUMMARY OF THE INVENTION

This invention is made in light of the above-mentioned situation. It is an object of this invention to propose a bed which provides multiple functions (a multi-functional bed) for the purpose of eliminating the above trouble caused by the conventional bed, reducing the labor of the nurse and keeping the patient in good hygienic condition.

The above object of the present invention is achieved by a multi-functional bed comprising: a lower capsule reinforced by a metallic frame which is supported at both ends thereof by a metallic supporting frame, said lower capsule being received within the metallic supporting frame and also being provided with cold and hot water supplying means and draining means; an upper capsule mounted on said lower capsule, said upper capsule divided into an upper half portion and a lower half portion, said upper half portion being detachable from the lower capsule and provided with vent holes while said lower half portion being provided with cold and hot water supplying means; a movable portion which is supported by said metallic supporting frame at both ends of said movable portion, said movable portion comprising an arcuate main frame, a rail mounted on both ends of said main frame and a moving frame movable on said rail, said moving frame being rotatable by a handle supported with said metallic supporting frame; a plurality of cushions placed on said movable portion, wherein one cushion fitted into another can be removed separately as required; and a net which can be wound or unwound by a winding portion disposed on the underside of said movable portion, said net windable on and unwindable from a winding portion which is provided on the underside of said frame of the movable portion being extendable as required under the frame of the movable portion in a widthwise direction of the bed to be fixed at a fixing portion mounted on the underside of said frame by way of two guide bars.

The multi-functional bed according to the present invention functions as an ordinary bed when cushions are placed on the frame of the movable portion. In accordance with the condition and at the request of the patient, the bed also functions as excreting means, as means for disposing the excrements sanitarily, and as showering or bathing means for cleaning the patient's body when the cushions are removed and the net is used to support the patient's body for the purpose of alleviating the labor of the nurse.

DESCRIPTION OF THE PREFERRED EMBODIMENTS

Preferred embodiments according to the present invention will be described in detail with reference to the accompanying drawings.

Figure 2:
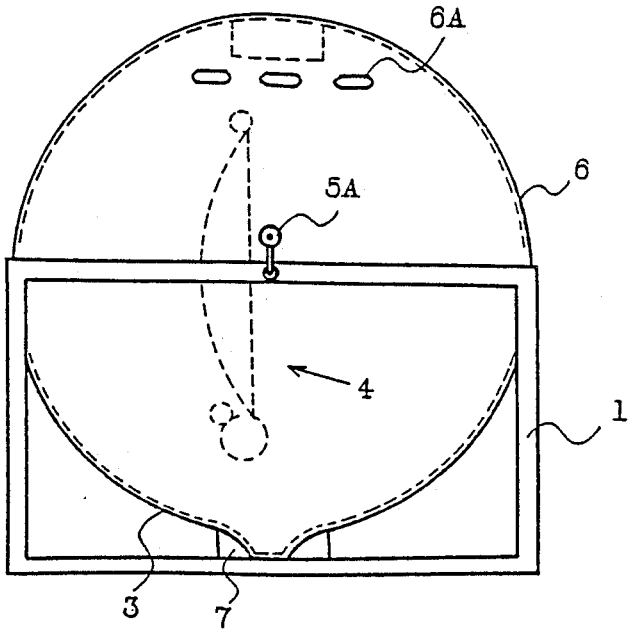
FIG. 2 is a cross-sectional view taken from the direction of arrows 2 and 2 of FIG. 1.

A multi-functional bed (hereinafter referred to as a bed) comprises as follows: A metallic supporting frame 1 supports at both ends a metallic frame 2 which reinforces a resin lower capsule 3, on which a movable portion 4 supported at both ends by said metallic supporting frame 1 is provided. The movable portion 4 is rotatable in either direction around a shaft 5 (in FIG. 2 the movable portion 4 is shown being rotated through 90°). On said lower capsule 3, there is detachably disposed an upper capsule 6 provided with a vent hole 6A. Under the lower capsule 3, there is arranged a stand 7 which is provided with a concave portion to protect a projected portion which constitutes draining means in the form of a draining groove in the lower capsule 3. 5A is a handle which allows said movable portion 4 to be rotated in either direction around the shaft 5.

As stated below in detail, said movable portion 4 mainly comprises a plurality of separate cushions *9a*, *9b*, *9c*, *9d* and *9e*, a frame 11 for supporting the cushions and a windable/unwindable net 8 which is disposed under said frame 11. Said cushions *9a*, *9b*, *9c*, *9d* and *9e* consist of a set of four main cushions *9a*, *9b*, *9c* and *9d* and a fifth cushion *9d* which is fitted into a cut-out portion of cushion *9c* (see FIG. 1).

Figure 3:
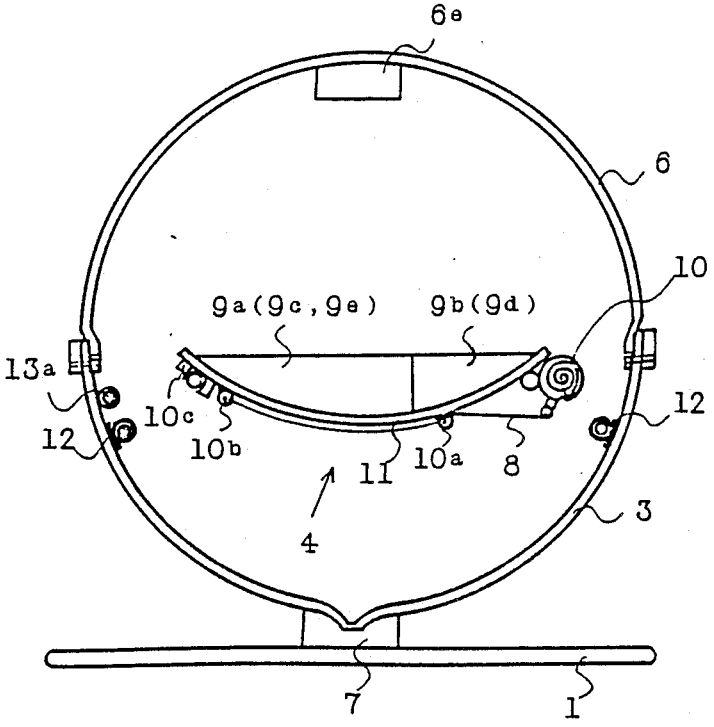
FIG. 3 is a cross-sectional view taken from the direction of arrows 3 and 3 of FIG. 1.

As shown in FIG. 3, the windable/unwindable net 8 stays wound on a winding portion 10 when it is not in use. The net is unwound from said winding portion 10 as required for use. The net 8 is made of strong, flexible and low water-absorbent material which permits the body of the patient to be supported therein.

Figure 1:
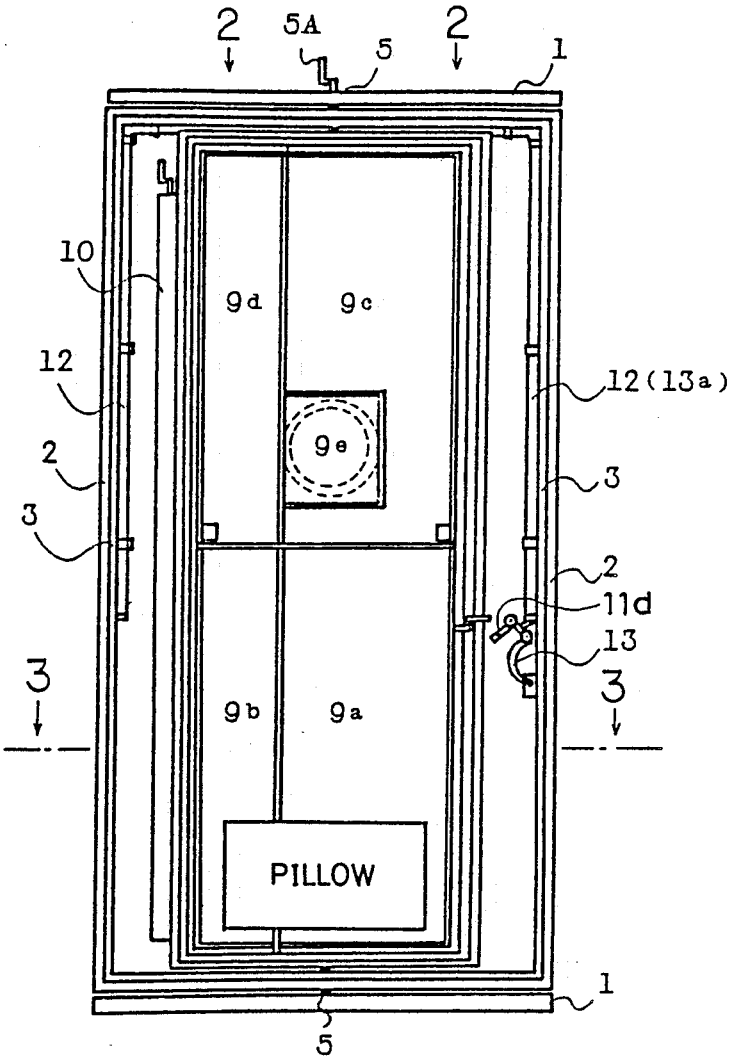
FIG. 1 is a plan view showing an embodiment according to the present invention.

Each of the cushions *9a*, *9b*, *9c*, *9d* and *9e* is so constituted as to be removable from the frame 11. Cushion *9e* is so constituted that it can be removed alone from the cushion *9c* to uncover a portion of the bed which can be conventionally adapted for the placement of a conventional stool (as indicated in FIG. 1 by double circles in broken lines) for the excretion of the patient. The bed is also constituted in such a manner that when the patient takes a bath, the cushions *9b* and *9d* can be removed so that the patient can be lowered into the bath tub through the place where the cushions 9b and 9d had been positioned, as described later.

Figure 4:
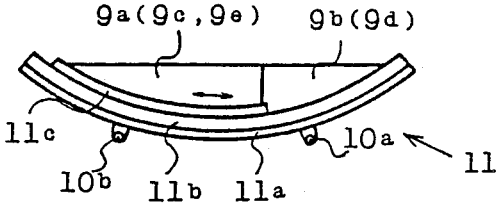
FIG. 4 is a view showing a detailed condition of a frame.

Said frame 11 will be described with reference to FIG. 4. The frame 11 is constructed in a double structure as shown in FIG. 4, and comprises an arcuate main frame 11a and a moving frame 11c. A rail 11b is mounted at each end portion of said main frame 11a so the moving frame 11c is movable along said arcuate main frame 11a by means of slide block (not shown) which fit in grooves of the rails 11b. The moving frame 11c is caused to move, for example, by a rack provided successively on the undersurface of said moving frame 11c, and a pinion which is provided being partially projected at the groove of the rail 11b disposed in said main frame 11a. Said cushions 9a, 9c and 9e are mounted on the moving frame 11c of said frame 11. Said cushions 9b and 9d are placed on the frame 11a directly.

Said winding portion 10 for winding the net 8 is constituted so as to wind up the net 8 by means of a motor driving mechanism (not shown) provided with a locking mechanism. The net 8 drawn out from said winding portion 10 is caused to pass over guide bars 10a and 10b (see FIG. 3 and 4) which are disposed at two points midway along the underside of the frame 11 to be fixed to a fixing portion 10c at the end of the frame 11.

There are also several means for supplying cold and hot water. Within said lower capsule 3, is a water supplying pipe 12 provided for post-cleaning when the patient uses this bed for excretion or for a bath. There is also provided a shower unit 13 (13a is a piping thereof) which is to be used at the time of taking a bath.

Figure 5:
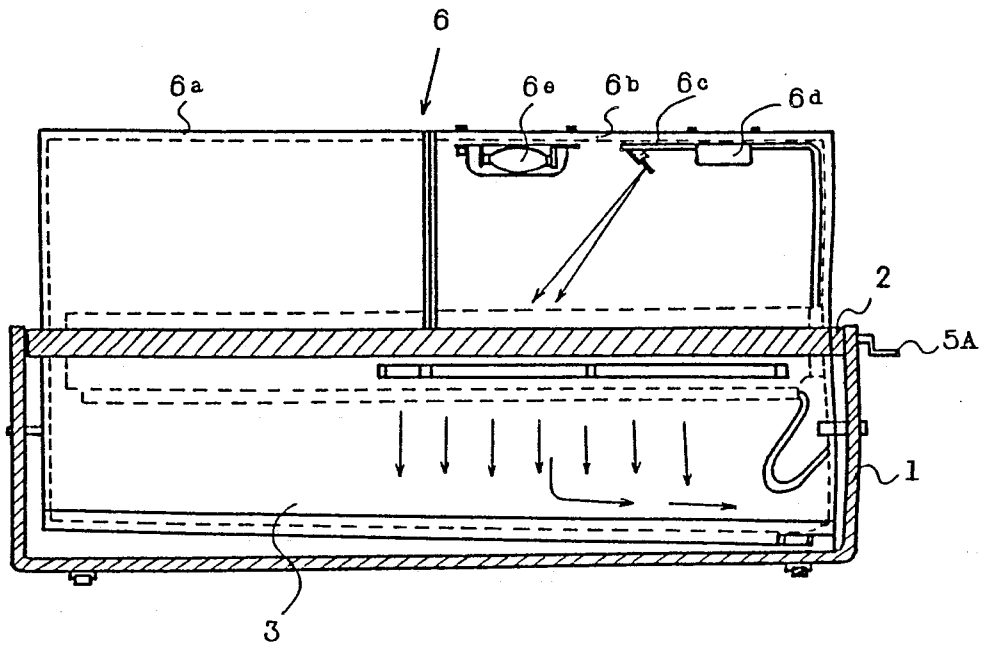
FIG. 5 is a longitudinally cross-sectional view of a bed in perspective of a preferred embodiment.

Said upper capsule 6 has a structure wherein the same is divided into two portions, as shown in FIG. 5. An upper half portion 6a covers the upper half body of the patient while a lower half portion 6b covers the lower half body of the patient. Both of the half portions are so constituted that the same are detachable as stated above. Within the lower half portion 6b, there are provided a hot water nozzle 6c adapted to clean the body of the patient who has completed excretion, a warm air blowing unit 6d adapted to dry the body of the patient who has completed cleaning his body and heating and health promoting means in the form of an infrared ray heater for heating the body of the patient or in accordance with the season, an ultraviolet ray lamp 6e adapted to produce a sun bathing or other effect.

Incidentally, the cushions 9a and 9b which are supported by said frame 11 to correspond to the upper half portion 6a can be raised by turning a net raising handle 11d shown in FIG. 1, for example, by way of a well-known gear driving method (not shown).

Figure 6:
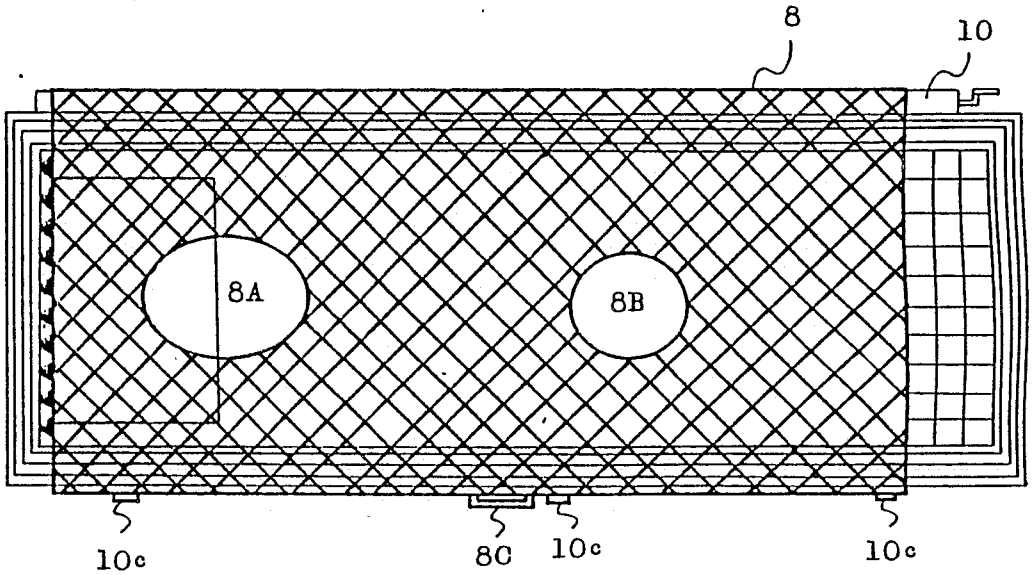
FIG. 6 is a plan view showing a state of a net extended.

FIG. 6 shows a state wherein said net 8 has been drawn out. The net 8 is provided with two cutouts, one corresponding to a position 8A of a face of the patient or the like and the other corresponding to a position of the cushion 9e (namely, a position of a stool). A fixing portion 10c for fixing a drawn out net 8 at the other end of the frame 11 relative to one end thereof is provided with the winding portion 10. A handle 8c is adapted to draw out the net from the winding portion 10.

The operation of the bed according to the preferred embodiments which are constituted as above will be described as follows:

Generally, the bed has the upper half portion 6a which is part of the upper capsule 6a removed and has only the lower portion 6b kept mounted in accordance with the situation of the patient. In this state, the patient can urinate and/or evacuate the bowels while lying in bed. That is, to do this, the cushion 9e shown in FIG. 1 is removed so that a stool with, for example, a cleaning/drying/heating seat, can be positioned in a conventional manner under the place where the cushion 9e has been put. Otherwise, the stool is arranged in preparation beforehand. In case the patient is in a serious condition, it is possible that the cushions are replaced with ones which quickly pass water. In any case, this multiple-functional bed permits the patient to clean his body by a shower through said hot water nozzle 6c after excretion and also to dry his body by means of the warm air blowing unit 6d. It is desirable to heat the body of the patient or the like in accordance with the season. To help the patient or the like to excrete, the nursing or attending person can rotate the movable portion 4 to an appropriate extent as required, which also facilitates the cleaning of the patient. In this case, it is also possible that the net is drawn out for use by following the same procedure as will be described later when the patient takes a bath.

Next, a procedure wherein the patient takes a bath will be explained. Prior to taking a bath, a soft resin bath tub formed into the same shape as the lower capsule 3 (the tub in this case can be regarded as a shallow bag-shaped item) is arranged in the capsule 3. Then, the net 8 is drawn out so that the end of the net can be fixed at the fixing portion 10c. After locking the winding operation of the net 8, the patient is moved towards said cushions 9a, 9e and 9c and the cushions 9b and 9d are removed.

Figure 7:
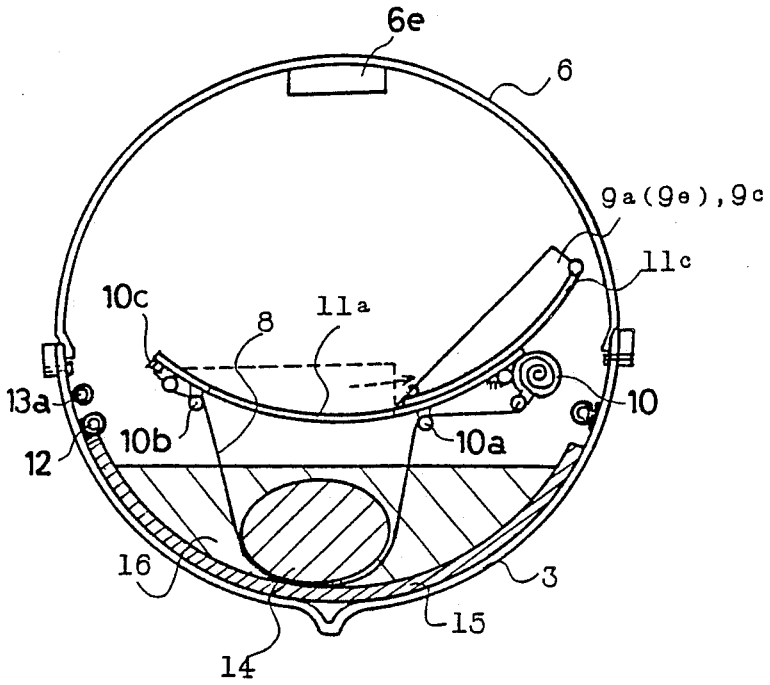
FIG. 7 is a transversely cross-sectional view showing a patient taking a bath.

A faucet (not shown) provided at the showering pipe 13a is opened to fill the bath tub with an adequate quantity of hot water. Then, as shown in FIG. 7, said moving frame 11c is moved in the direction of the winding portion 10. This operation causes the patient or the like to be moved gradually onto the net 8 from said, cushions 9a and 9e and 9c. In this state, the tension of the net 8 is slackened as required to some extent so that the appropriate part of the body of the patient can be immersed into the hot water. The patient gets his body cleaned or heated and then has his body raised by tightening the net 8 to return his body onto the nets 9a, 9e and 9c by following the reverse procedure relative to the first one stated above. In FIG. 7 reference numeral 14 denotes the body of the patient, reference numeral 15 denotes a resin bath tub and reference numeral 16 denotes hot water.

The above embodiment is an example according to the present invention. The present invention is not limited only to this, but many more modifications or functions can be added.

For example, the patient may operate a manual switch by himself to clean his body after excretion. It is also possible to automatically clean the body of the patient by means of a sensor that detects the completion of the excretion of the patient or by means of a sensor that detects humidity. Mounting the above-mentioned upper half portion 6a on the lower capsule 3 at all times conveniently permits the patient to gain suitable temperatures and humidities at a low cost. Further, it is possible to let the patient take a shower with his upper body raised in bed instead of immersing his body in the bath tub. In this case, as stated above, the patient takes a shower with the cushions (a) and (b) raised at an upper half thereof, with required portions made waterproof appropriately by vinyl sheets, for instance, and with the patient enclosed with vinyl curtains or the like.

The method wherein the cushions (a) and (b) are raised or the movable portion is rotated, or the manner in which the shower or a showering pipe is arranged as stated above can be modified appropriately as required. The above embodiments show an example in which the patient uses a manual switch and several kinds of sensors to clean his body. A timer combined with the devices according to the present embodiments stated above allows the patient to clean his body at predetermined intervals of time. In this case, it is possible that the patient will clean his body as required even if the sensor fails to operate.

The direction at which the frame 11 of said moving portion 4 is caused to move can be changed to a horizontal direction in accordance with the modified shape of the capsule. The shape of the capsule is not limited to the cylinder type but can take a form of multilateral type or a form of a combination of a cylinder with a multilateral type. Incidentally, a microcomputer is preferably introduced to control each function of the bed so that the labor consumed by the nurse can be reduced.

As stated above, this invention has the remarkable effect that a bed can be realized which provides multiple functions as means for alleviating the labor of the nurse while keeping the patient in good hygienic condition.

What is claimed is:

1. A multi-functional bed which comprises: a lower capsule reinforced by a metallic frame which is supported at both ends thereof by a metallic supporting frame, said lower capsule being received within the metallic frame; an upper capsule mounted on said lower capsule; a movable portion which is supported by said metallic supporting frame at both ends of said movable portion; a plurality of cushions placed on said movable portion; and a net which is windable to and unwindable from a winding portion disposed under said movable portion.

2. The multi-functional bed according to claim 1, wherein said lower capsule is provided with cold and hot water supplying means and draining means.

3. The multi-functional bed according to claim 1, wherein said upper capsule is divided into an upper half portion and a lower half portion, said upper half portion being detachable from the lower capsule, said upper capsule being provided with vent holes, said lower half portion being provided with cold and hot water supplying means, warm air supplying means, and electrical heating/health promoting means.

4. The multi-functional bed according to claim 1, wherein said movable portion comprises an arcuate main frame, a rail mounted on each end of said main frame and a moving frame movable on said rail, said moving frame being rotatable with a handle supported by said metallic supporting frame.

5. The multi-function bed according to claim 1, wherein one cushion positioned in a cut-out portion of another cushion can be removed separately as required.

6. The multi-functional bed according to claim 1, wherein said net windable to and unwindable from a winding portion which is provided on an underside of a frame of said movable portion is extendable as required on said underside of said frame of the movable portion in a widthwise direction of the bed to be fixed at a fixing portion mounted on the underside of said frame by way of two guide bars.

* * * * *